United States Patent [19]

Duley et al.

[11] Patent Number: 4,668,951

[45] Date of Patent: May 26, 1987

[54] INDUCTIVE LOOP VEHICLE DETECTOR

[75] Inventors: Richard K. Duley; David F. J. Evans, both of Hampshire, England

[73] Assignee: Sarasota Automation Limited, Winchester, England

[21] Appl. No.: 521,814

[22] Filed: Aug. 10, 1983

[30] Foreign Application Priority Data

Aug. 13, 1982 [GB] United Kingdom ..... 8223409

[51] Int. Cl.[4] ..... G08G 1/01

[52] U.S. Cl. ..... 340/941; 340/825.15; 340/825.05; 340/115; 331/64; 331/65

[58] Field of Search ..... 340/941, 512, 52 R, 340/115, 146, 825.15, 825.65, 825.05; 331/64, 65

[56] References Cited

U.S. PATENT DOCUMENTS

| | | | |
|---|---|---|---|
| 3,868,626 | 2/1975 | Masher | 340/939 |
| 3,943,339 | 3/1976 | Koerner et al. | 340/941 |
| 3,989,932 | 11/1976 | Koerner | 340/939 |
| 4,296,401 | 10/1981 | Duley | 340/941 |
| 4,491,841 | 1/1985 | Clark | 340/941 |

*Primary Examiner*—James L. Rowland
*Assistant Examiner*—T. Rittmaster
*Attorney, Agent, or Firm*—Sughrue, Mion, Zinn, Macpeak and Seas

[57] ABSTRACT

In a vehicle detection apparatus having a plurality of channels, each arranged for detecting vehicles according to their influence upon the frequency of a respective loop oscillator the oscillation frequency of which is dependent on the inductance of a respective vehicle-sensing inductive loop, a common computer performs a calculation for each channel in turn whereby changes in the frequency of the respective loop oscillator are monitored and analysed. In one embodiment, the computer calculates an appropriate operational number, the time taken for that particular number of loop cycles to occur is measured and stored as a period count and the period count is compared with an environmental reference number to determine whether or not a vehicle detected flag should be raised or lowered. Neither the operational number calculated by the computer nor the reference number is fixed but provision is made for updating both. In another embodiment, the computer calculates an appropriate period of time and the number of loop cycles occurring in that time is counted and that count stored for use in determining whether the vehicle detected flag should be raised or lowered. Again, provision is made for updating the calculated period of time and the reference number.

18 Claims, 5 Drawing Figures

INDUCTIVE LOOP VEHICLE DETECTOR

This invention relates to a vehicle detector, and more particularly to an inductive loop type of vehicle detector in which the loop is made the frequency determining element of an oscillator.

It is a common practice in vehicle detection to make an inductive sensor loop a frequency determining element of a tuned circuit in a Colpitts oscillator. Inductance changes in the loop due to the presence of a vehicle may be sensed by making frequency or period measurements on the loop oscillator.

Period measurement is commonly made by measuring the period of a predetermined number of loop oscillator cycles and making a decision on vehicle detection by comparing the measured period with a reference period itself generated in dependence upon a previous measurement. This basic procedure is to do no more than would be done by applying a frequency counter with a period measurement facility to the loop oscillator.

A system based on this technique is described for example in British patent specification No. 1,513,173 (U.S. Pat. No. 3,989,932). In this specification a loop counter counts a set number of loop oscillator cycles—specifically 1024—during which time clock pulses are separately counted as a measure of the duration of the set number of cycles. That period is, of course, a function of frequency and thus of loop inductance. The latter may vary widely with the size and shape of loop used in a particular installation. Vehicle detection is, in simple terms, made by determining whether the difference between the current clock pulse count and a preceding count exceeds a threshold value. It will be appreciated that the threshold expressed in a defined number of clock pulse counts represents a predetermined time deviation. Thus vehicle presence is defined on the basis of a predetermined time deviation as a percentage of an indeterminate time period which can have a wide range. This variance of percentage sensitivity can be controlled to some extent by allowing manual adjustment in the apparatus of the number of loop cycles counted or the threshold deviation but this requires a skilled setting up of each individual installation including some estimation of the likely oscillator frequency with the loop to be used. In practice the number of loop counter settings is limited and once set to a count value that value remains whatever changes are made in the loop unless another special setting up procedure is performed.

This disadvantage is compounded in multi-loop installations where a plurality of loops are scanned. A single oscillator may be switched among the loops or each loop may have its own oscillator. Such arrangements are disclosed in British patent specification No. 1,513,173. The frequency outputs are successively applied to a loop counter acting in conjunction with the other detection elements already discussed and thus in the normal course where the loop frequencies differ, differing percentage sensitivities will apply. There is also another practical difficulty which may apply in a multiple-loop installation. The time of successive samplings of a given loop may not be known with any accuracy since the time to perform the loop cycle counting operation is not predetermined. The result may be that a given loop is not sampled as rapidly as circumstances require.

There will be described hereinafter a vehicle detector apparatus in accord with the present invention in which the time for which loop cycles are counted is essentially predetermined. The apparatus finds particular utility in a multiple-loop installation in enabling the scanning time to be known to within reasonable tolerance whatever the loop inductances.

According to the present invention there is provided a vehicle detection apparatus connectable to a vehicle sensing loop and including an oscillator for oscillating at a frequency dependent on the inductance of the loop, means for repetitively measuring the duration of a plurality of oscillator cycles, and means for analysing successive measured durations to determine the presence of a vehicle, and a circuit arrangement for establishing the number of oscillator cycles to be measured comprising:

a counter for counting oscillator cycles, a timer connected to control said counter to count oscillator cycles for a predetermined interval, and means for storing the number of oscillator cycles counted in said interval as a value determining said number.

The circuit arrangement preferably includes means responsive to one or more specific conditions to initiate the number establishing procedure. One such condition is turning on power. Another is a general reset command. To this end the timer is actuated. After the number is established, the apparatus operates in a normal detection mode using that number to set the number of oscillator cycles whose duration is measured until such time as circumstances arise requiring a fresh initialising procedure.

It will be seen that whatever the loop inductance and consequent oscillation frequency, the number of cycles established gives rise to a duration approximating that of the predetermined timer interval. It does not need to be precise. Thus if the analysis of the duration (measured for example by counting clock pulses as discussed above) is by comparison with a reference and by determining whether the time difference (expressed for example in terms of clock pulses), exceeds a set threshold, the threshold will be an approximately constant percentage of the duration measured and provide a constant sensitivity in terms of time. Vehicle detection apparatus embodying this principle can therefore be installed at any desired calibrated sensitivity, e.g. by making the threshold adjustable or scaling the established number, without regard to the loop with which it is used over a wide range of loop inductance. For convenience the predetermined duration may be referred to hereinafter as the base time (or time base) and the established number of cycles as the operational cycle number.

In a preferred form of the above apparatus of the invention the circuit arrangement includes a microcomputer for controlling actuation of the timer, the number storing means being data storage associated with the microcomputer. The microcomputer also provides the means for analysing successive measured durations. The duration measuring means may include a pre-settable down counter which is set to a count value established by the stored number and is operable to count down to the set point, e.g. the count zero point. A further clock pulse source and a further counter operable in synchronism with the down counter are arranged for counting clock pulses up to the reaching of the set point so as to achieve a count value that is dependent on the duration of the aforesaid pre-set number in the down counter. By "operable in synchronism" is meant that it is, possible but not necessary for the further counter to start counting at exactly the same time as the down counter. They should however start in a defined relationship approximating a simultaneous start.

Reverting to the multi-loop installations discussed above, it will be appreciated that the principles already discussed can be extended to such an installation, in that the circuit arrangement by which is established the number of oscillator cycles to be measured, can be applied with each loop in turn and the obtained number pertaining to each loop stored for use in the normal loop-scanning detection operation. Thus as scanning progresses, the number of oscillator cycles measured for each loop will have a duration approximating the timer interval and an accurately known percentage time sensitivity can be set for each loop irrespective of the inductance of that loop. In addition both the individual loop scanning interval and total scanning cycle time will be known to within a reasonably close tolerance.

Stemming from the ideas expressed in the preceding paragraph, in another aspect of the invention there is provided a vehicle detection apparatus connectable to a plurality of vehicle sensing inductive loops and including oscillator means connectable to said plurality of loops for each loop to provide a frequency determining element for the oscillator means, means for successively sampling the respective oscillation frequencies established by said loop with the oscillator means, said sampling means including means for measuring the duration of a plurality of cycles of the oscillation frequency being sampled, and means for analysing successive durations measured in respect of each loop to determine the presence of a vehicle at that loop; and a circuit arrangement for establishing the number of oscillator cycles to be measured in respect of each loop, comprising a counter for counting oscillator cycles, a timer connected to control said counter to count oscillator cycles for a predetermined interval, storage means capable of storing a plurality of count values from said counter; and control means operable to control an initialising procedure in said apparatus to perform a series of samplings associated with different ones of said loops, to actuate said timer for each loop sampled in the initialising procedure whereby said counter achieves in the predetermined interval a count value dependent on the frequency of the sampled loop; and to cause the count values associated with the different loops to be stored in said storage means; and said control means being further operable to put the apparatus into a normal vehicle detection mode in which the respective stored count value associated with each loop determines the number of oscillator cycles whose duration is measured by said sampling means.

It will be appreciated that in the apparatus set forth in the preceding paragraph the oscillator means can comprise a single oscillator circuit to which the loops are successively connected; a respective oscillator circuit for each loop in which case the oscillators may be selectively enabled as the scanning cycle progresses or the oscillators may be running continuously; or more than one oscillator circuit may be selectively connectable to a given loop. This latter instance is of importance where a loop at a particular location may be used for two traffic monitoring functions. The scanning of the loop with the two oscillators can be associated with differing sensitivities or other detection parameters in the analysing means, e.g. the microcomputer referred to above.

The concept of measuring the or each loop over an essentially fixed period or base time can be realised in another way. Once again a timer is used to define the period. In this aspect of the invention there is provided a vehicle detection apparatus connectable to a vehicle sensing loop and including an oscillator for oscillating at a frequency dependent on the inductance of the loop, means for repetitively measuring the duration of a plurality of oscillator cycles, means for analysing successive measured durations to determine the presence of a vehicle, and a circuit arrangement for establishing the number of oscillator cycles to be measured comprising:

a timer actuable in a predetermined relationship to the oscillator waveform to provide a signal at a predetermined time following actuation; and said analyser means being responsive to said signal and to the oscillator waveform to measure the interval between said timer signal and a predetermined point on the waveform following said timer signal.

In implementing this form of the invention, the timer period does not need to be known though it needs to be accurately reproduced on each occasion the timer is actuated. The timer may provide an accurately defined pulse and be triggered in response to a positive-going (say) zero-crossing of the oscillator waveform (assuming this is sinusoidal) or by a defined edge of a pulse generated by the oscillator or from its waveform. For convenience, assume the predetermined point on the oscillator waveform used in the time measurement is the next positive-going zero-crossing following the end of the timer pulse. It could be any nth such defined point where n is specified but the next following ($n=1$) point is preferred. Since the timer triggering is synchronized to the waveform, a measurement of the time of the next positive-going zero-crossing following the pulse is a measure of the duration from the trigger time since the pulse duration is the same in each case. In any event it is the variation in time which is of importance in making detection decisions and thus the measurement of the time between the trailing edge of the pulse and the next positive-going zero-crossing is entirely satisfactory.

It will be noted that this form of the invention shares with that described earlier the concept that the base time (i.e. the timer period) against which variations are measured is essentially constant to provide approximately the same time percentage sensitivity whatever the loop inductance. It is assumed here that the timer period is equal to a substantial number of times the oscillator period. A typical timer period is contemplated to be 10 mS equal to 500 oscillator cycles at say 50 kHz. Thus in the assumed case the maximum period to the end of the time measurement would be 10 mS plus 1 cycle which is 10.02 mS.

One problem arising in this procedure is that if the oscillator frequency is rising due to the approach of a vehicle to the loop, the measured time difference decreases as the relevant zero-crossing advances in time. If that zero-crossing advances to a time equal to or earlier than the end of the timer pulse, the time difference will then be measured to the next positive-going zero-crossing so that there will be a jump from a time difference approaching zero to the then obtaining period of the oscillator. This problem can be overcome by monitoring at least in an initialisation phase of the apparatus, and preferably at each scan sequence of the detector in a multi-loop installation, the number of oscillator cycles within the timer period. The detection of a zero-crossing coincident with the end of this period, whether advancing or retreating in time, can be used to adjust the initial cycle count value. A calculation of the current oscillator period can then be made from the monitored number of cycles in the timer period. Thus the jump or transition from one cycle to the next can be allowed for in analysing the difference measurements and their direction and rate of change.

Yet another approach which is presently preferred is to count, at each measurement, the number of cycles from the start of the timer period to the end of the next positive-going zero-crossing (to use the same example as above) following the timer period. This will be a precisely definable interval containing a precisely known number of loop oscillator cycles. To calculate the loop oscillator period requires the timer period to be known, and it can be set with precision using digital counting techniques. The time difference, which will be called $\tau$, between the end of the timer period and the next positive-going zero-crossing is also accurately measurable with digital counting techniques: and the total period will, in the example being considered, coincide with an integral number of loop oscillator cycles that can be readily counted.

In order that the invention and its practice may be better understood, two embodiments will be described with reference to the accompanying drawings, in which.

Figure 1:
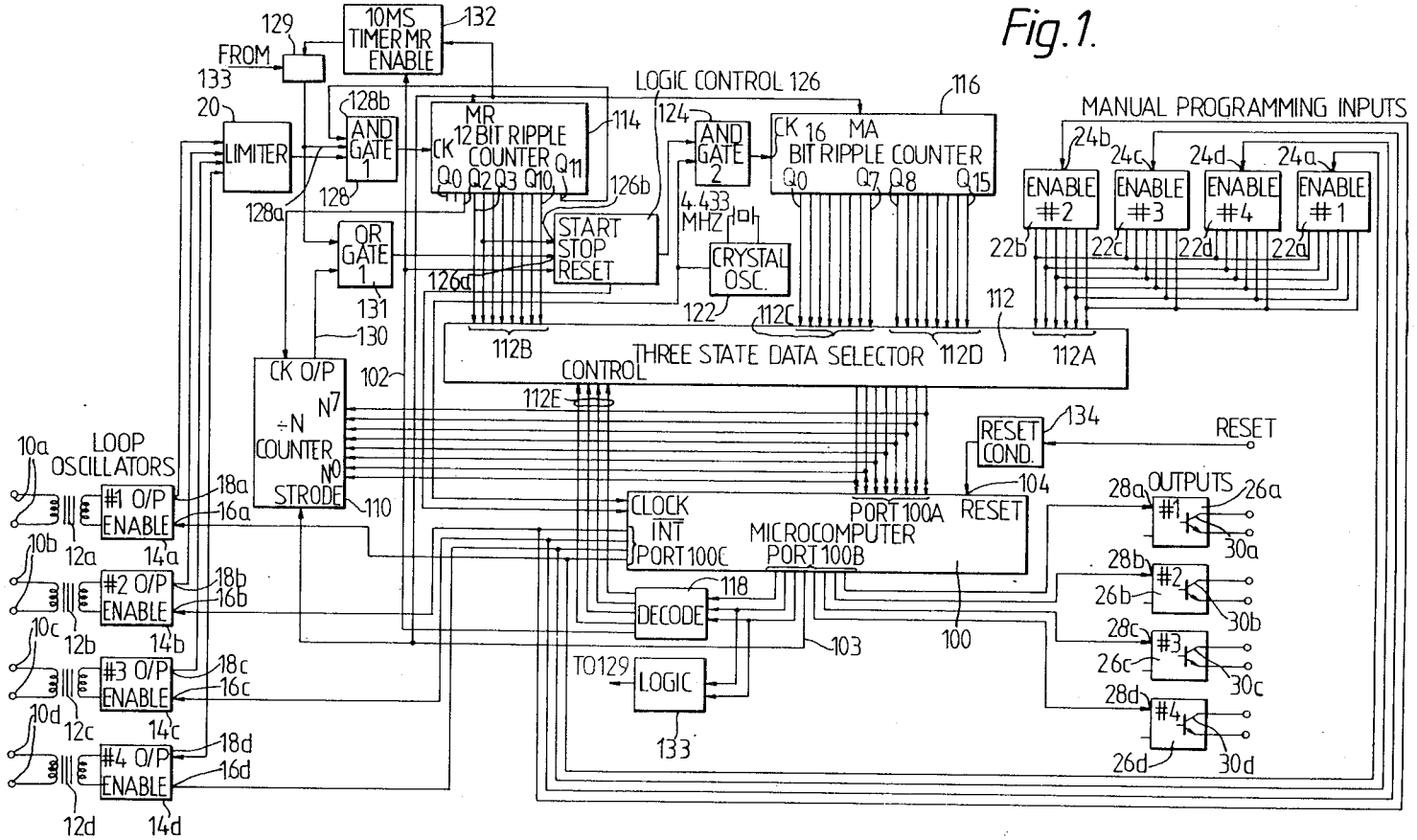
FIG. 1 is a block circuit diagram of a multiple-loop, vehicle detector apparatus in which an initialisation procedure is used to establish the number of oscillator cycles for each loop that occurs within a preset timer period.

Referring to FIG. 1, there is shown apparatus for scanning four loops (not shown) connectable to terminals 10*a* to 10*d* respectively. The loops are connected via respective isolating transformers 12*a* to 12*d* into the tank circuits of respective loop oscillators 14*a* to 14*d* that are of conventional form, e.g. Colpitts oscillators. In the installation to be described the loop oscillators are sequentially scanned by successively applying to them an enable signal on respective terminals 16*a* to 16*d*. The enable signals are supplied from a microprocessor or microcomputer 100 to be described further below. Each loop oscillator has a respective output 18*a* to 18*d* that is applied through a limiter 20 to common signal-handling circuitry about which more is said below.

The microcomputer 100 has four input devices 22*a* to 22*d* associated with it that store data relating to the detection parameters to be applied with a respective loop. These devices need not be described in detail here but may comprise manually-settable switches and controllable buffer logic for reading the switch data to the microcomputer. Each device 22*a–d* has a respective enable input 24*a* to 24*d* connected to the respective enable input 16*a* to 16*d* of the associated loop. Thus a loop oscillator and its associated input device are selected simultaneously.

The microcomputer also controls four output devices 26*a* to 26*d* associated with respective loops. Each device has a respective presence input 28*a* to 28*d* controlled by the microprocessor and is shown as having an output transistor 30*a* to 30*d* respectively, for example for actuating external relays or any other desired function. The precise nature of the output devices is not relevant to an understanding of this invention. They are not successively enabled during loop scanning but are actuated only when a vehicle presence is detected at the associated loop.

The microcomputer is programmed to perform three main functions: firstly, general control of the apparatus; secondly, data storage of both data acquired from operation of the loops and of input data from the devices 22; and thirdly, analysis of the loop data in accord with the detection parameters and the activation of an output device 26 when a vehicle presence is detected. The particular circuit illustrated is designed around the M6805 type device available from Motorola Inc. Numerous other devices are available. Choice largely resides in a balance of performance against cost.

The microcomputer 100 has three ports 100A, B and C. Port 100A is an 8-bit bidirectional port used for data transfer. The port 100A is connected directly to the 8-bit programmable input of a pre-settable down counter 110 into which, for each loop oscillator measurement, is set a number determining the number of cycles of the oscillator whose duration is to be measured. The port 100A is also connected through data selection logic 112 to selectively receive 6-bit data from an enabled input device 22 supplied to a port 112A; to a 12-bit ripple counter 114 used in an initialisation procedure to be described connected to port 112B; and to a 16-bit ripple counter 116 used for the duration measurement connected to ports 112C and 112D. Both counters have each bit available as an output $Q_O$ to $Q_N$ representing bit values $2^O$ to $2^N$. The counter 114 (e.g. a 4040 device) has 11 bits used in the initialisation procedure (count up to 2048) but the three least significant bits are ignored as regards supplying data to the microcomputer and the twelfth bit ($Q_{11}$) is used as a control output. Thus an 8-bit input (bits 3 to 10) is connected to port 112B of the logic 112. The 16-bit duration counter is used in full and in conventional manner its data is transferred in two 8-bit bytes to the 8-bit port 100A, the low and high bytes being connected to ports 112C and 112D respectively. The selector logic 112 uses readily available, three-state logic devices capable of buffering and switching up to 8-bits. Unless selected for data transfer the output of such devices is "neutral" and does not affect the high/low states from a selected logic device connected to the microcomputer port 100A. Four control inputs 112E are used to control selection of the four ports 112A–D.

The microcomputer has a second 8-bit port 100B four bits of which are dedicated to controlling respective output devices 26. Three of the other four bits are connected as inputs of a 3-to-8 line decoder 118, and the remaining bit on line 103 provides a master reset (MR) and a strobe input for pre-setting counter 110. The four output terminals of the decoder are connected to respective ones of the control inputs 112E.

The microcomputer has a third, 4-bit port 100C whose terminals are connected to the respective enable inputs of loop oscillators 14*a–d* and their associated input devices 22*a–d*. The scanning sequence is derived at this port. By use of decoders up to fifteen loops could be scanned.

The microcomputer has its clock input (clock) connected to a 4.433 MHz crystal-controlled clock pulse source 122 that also supplies clock pulses to the clock input (CK) of duration counter 116 through a gate 124. The transmission of clock pulses through the gate 124 is controlled by a second gate input that in turn is controlled by a logic unit 126. The signal inputs controlling the logic unit which operates as a latch are described further below.

Under both the initialisation procedure and normal detection operation, the selected loop oscillator supplies its frequency output, squared by limiter 20, to the clock input (CK) of counter 114, via a control gate 128 performing an AND function. The clock input (CK) of counter 110 is connected to the $Q_2$ output of counter 114 so that the latter acts as a divide-by-8 prescaler for counter 110. This is consistent with the ignoring of the three least significant bits in the data obtained from the counter 114 during the initialisation procedure. This data is used for pre-setting counter 110 as will be further described. The counter 110 has an output on line 130 that is actuated when the counter reaches zero and is supplied through an OR-gate 131 to input 126*a* of the logic unit 126 as a stop signal to denote the end of a loop measurement and terminate the supply of clock pulses to duration counter 116.

The start of clock pulse counting by counter 116 for an individual loop measurement in normal operation is also controlled with the aid of the counter 114. The start input 126*b* of the latching logic unit is connected to the $Q_3$ output of the counter 114. The reason for the start connection to output $Q_3$ arises out of adoption of sequential switching-on of the loop oscillators. The enabled oscillator is given a period to settle before duration measurement begins. The counter 114 provides this settling period by not enabling the gate 124 through logic unit 126 until the start of the 8th loop oscillator cycle.

The counter 114 serves to synchronize the starting conditions for each loop measurement. The Q outputs are reset to low initially. Counters 110 and 114 are clocked on positive- and negative-going edges respectively at their clock input (CK). Counter 110 is first clocked at the beginning of the 8th loop oscillator cycle at which time the $Q_3$ output of counter 114 goes high to provide the start signal to logic unit 126.

The counter 114 is used in the initialisation procedure. The gate 128 through which it is clocked by the active loop oscillator is controlled by a timer 132 that is enabled by the microcomputer over line 102 to generate a pulse of 10 mS duration. The timer pulse is supplied to gate control input 128*a* to open the gate for loop cycle pulse transmission provided that a second control input 128*b* connected to the $Q_{11}$ output of counter 114 is low: which it normally will be. The decoder 118 is arranged to maintain the data selector logic 112 in a neutral state at that time.

The output of the timer 132 is applied to the gate 128 through a further gate 129. This gate is enabled to pass timer pulses by logic 133 connected to two of the inputs of decoder 118. The purpose of this circuit is to enable the timer to supply its pulses during initialisation but to maintain input 128*a* enabled during loop measurement so as to be unaffected by the timer. Since only five of the input states of decoder 118 have been used for other control functions, there are states available which can be used by the microcomputer to control the timer output circuit. The output of the timer is also supplied through OR-gate 131 to the logic unit 126 as a means of signalling the end of a timer pulse to the microcomputer.

The initialisation procedure is itself initiated by activation of a rest input 104 of microcomputer 100 by a reset condition sensing circuit 134. Circuit 134 is operable to generate a reset signal on initial application of power to the whole detector circuit (power-up) or by a manual or electrical reset input applied to it. The reset input causes the microcomputer to go into an initialisation routine and to issue a reset signal on line 103 that is supplied to the reset inputs (MR) of the counters 114 and 116, the timer 132 and the logic unit 126.

The purpose of the initialisation procedure is to establish approximately the number of cycles of each loop oscillator that occur in the timer period and to store these numbers for use in the normal measurement operations. These numbers (or sub-multiples of them) constitute the operational cycle number for each loop.

The microcomputer 100 enables the first loop oscillator 14*a* and, after a short delay determined within the microcomputer or by a separate timer, enables the timer 132 to generate its 10 mS pulse for the duration which gate 126 is open. Gate 129 is held open at this time. The delay allows the selected oscillator to settle and thereafter the counter 114 counts loop oscillator cycles for the 10 mS period. The circuit parameters are chosen so that even at the highest loop oscillator frequency the $Q_{11}$ output of counter 114 does not go high so that counting ceases at the end of the timer pulse. The end of the timer pulse is signalled to the $\overline{INT}$ terminal of the microcomputer by way of logic unit 126. Alternatively the microcomputer may act on an internal timing operation chosen sufficiently long to ensure the timer pulse has ended. The microcomputer then activates the data selector logic 112 to transfer the bits at the $Q_3$ to $Q_{10}$ outputs of the counter 114 to port 100A. These bits are entered into memory space labelled as pertaining to the first loop oscillator.

The resolution obtained by discarding the three least significant bits is to 8 loop oscillator cycles but this is consistent with the subsequent counting operation of the counter 110. Having acquired the data for the first loop oscillator, the procedure is repeated. The microcomputer issues a sequence of enable and master reset signals in order to successively enable oscillators 14*b, c* and *d*, enabling the timer each time, and so as to acquire from such loop oscillator a count value representing the number of cycles of each oscillator occurring in 10 mS. The four labelled values are then available in the memory space for subsequent use. The 10 mS period need not be precisely held; typically an accuracy of ±5% will suffice. It is sufficient to acquire an operational cycle number representing about 10 mS for each oscillator. This number is thus established at some value consequent on the operational condition of the relevant loop oscillator at the time the sample is taken. It is not set into the apparatus and may have different values at different times. The value achieved will not be known in normal use. It is the maintenance of the essentially constant time base that is important.

After the initialisation procedure, the timer 132 is no longer required for normal operation. The gate 129 is held closed so that the enabling of the timer each time a strobe signal is applied to down counter 110 is of no practical effect. The microcomputer is now ready to perform a repetitive sampling and analysis routine on the four loop oscillators. As each oscillator is enabled for sampling the same procedure is gone through as follows, taking the first oscillator 14*a* as an example.

The oscillator 14*a* is enabled and at the same time a reset signal is applied over line 103 to the counters 114 and 116. This same signal is applied as a strobe signal to the down counter 110. By this time the microcomputer has made available from the memory space the operational cycle number pertaining to the first oscillator. This value appears at port 100A and the strobe signal pre-sets this value into counter 110. The reset to the counter 114 not only clears the counter for the next counting operation but ensures that the control input 128*b* of gate 128 is low to allow transmission of loop oscillator pulses. The counter 114 immediately starts counting loop oscillator cycles and at every eighth cycle applies a clock pulse to the counter 110 to reduce its count value by one. At the start of the eighth oscillator cycle, by which time the loop oscillator will have settled, the $Q_3$ output of counter 114 activates the start input 126*b* of logic unit 126 to open gate 124. The counter 116 now starts counting clock pulses and this continues until the down counter 110 reaches zero whereupon the counter outputs a stop signal to logic unit 126 which closes the gate 124 to terminate clock pulse counting. The logic unit also signals the closure of gate 124 to an input $\overline{\text{INT}}$ of the microcomputer to inform the latter that the duration measuring operation is completed. The microcomputer now activates the selector logic 112 to read in the low and high bytes at ports 112C and D and thereby acquire the count value in counter 116 as a measure of the duration of the number of loop cycles pre-set into the down counter 110.

The enable signal at input 16*a* of oscillator 14*a* will have been held during the whole sampling operation. The enable signal will also have been applied to input device 22*a* for the whole sampling period so that the operating parameter data can be read in by the microcomputer at any appropriate time. However, a preferred sensitivity control requires the data to be read in early insofar as that data includes a sensitivity setting. Still more preferably the data is read in just once at the first enabling of each input device following a general reset of the whole circuit. The data is then held in memory space within the microcomputer 100 for use as required during subsequent sampling sequences.

A convenient sensitivity control is to adjust the period over which loop oscillator cycles are counted. As so far described this is closely approximate to the period of timer 132 (10 mS). However, a submultiple of this period, (i.e. 5, 2.5 or 1.25 mS), can be readily obtained by dividing by $2^P$ which is achieved by shifting the pre-setting number for a given oscillator held in the memory space by (P) bit places before application to the pre-set input of counter 110. This requires an early read-in of the value of P for the oscillator about to be sampled. After analysing the period data for the first counter the operational cycle can now continue by sampling the second loop oscillator 14*b*, to which end the microcomputer terminates the enable signal to loop oscillator 14*a* and applies an enable signal from port 100C to the second oscillator and to the input device 22*b* for acquisition of the parameters set therein. A reset/strobe signal on line 103 is now used to preset the counter 110 with the operational cycle number pertaining to the second loop oscillator.

As the period measurement for each loop oscillator is acquired it is analysed during the count period for the next loop oscillator to determine changes in period as compared with earlier measurements and in the light of the pre-set parameters. This analysis can employ known techniques that need not be discussed here. In practice detection will be signalled if the current value from counter 116 departs from a value previously established by a pre-set threshold. The established value can include tracking adjustment for environmental change as is well known. If at any time the analysis leads to a decision that a vehicle is present at the loop in question the microcomputer activates the relevant output device 26 via port 100B.

It will be appreciated from the foregoing description that allowing for subsequent variations in loop oscillator frequency, the counting of each loop oscillator for the operational cycle number set up by the timer 132 will ensure that the duration of the period count is closely approximate the timer period—10 mS in the example quoted. Detection by the difference between a new duration count value from counter 116 and the established value exceeding a threshold is equivalent to exceeding a time difference threshold, that is the count threshold multiplied by the clock period, and this threshold is independent of the loop oscillator frequency. Since the base time is predetermined as the timer period, the time sensitivity of the apparatus operating with given parameters, i.e. time threshold as a percentage of the base time, will be essentially constant irrespective of loop oscillator frequency. Clearly by adjustment of the respective pre-set parameters a desired individual time sensitivity can be obtained for each detector loop. It can be shown that this mode of operation provides for a given percentage inductance sensitivity to be obtained for a loop for given pre-set parameters.

Although the apparatus of FIG. 1 is intended for operation with four loops, it is readily apparent that the teachings of the above embodiment can be applied to a sigle loop detector or to any number of loops. With a multiple-loop apparatus, since the actual time for sampling the loop is independent of frequency, the total dwell time for each loop (that is total sampling and data processing time) will be known to a good degree of accuracy. Consequently, the rate at which any individual loop in the system is sampled will also be known without regard to the inductances of the loops employed and consequent differences in oscillator frequency.

The embodiment of FIG. 1 can include further refinements. It has already been noted that the $Q_{11}$ output of counter 114 will not normally go high, i.e. the count will not normally exceed $2^{11}$. If during the initialisation procedure the $Q_{11}$ output of counter 114 goes high, this is taken as an indication that there is a fault. The high $Q_{11}$ output will close the gate 128 and leave all the $Q_3$ to $Q_{10}$ outputs low so that the microcomputer reads in a count value of zero which it takes to be a fault condition.

The timer 132 can be realised using analogue circuitry. However, the interval could be generated digitally, as by counting an appropriate number of clock pulses; or from software associated with the microcomputer.

The constant time sensitivity may be obtained by a second form of the invention that also uses a timer to provide a base time. An embodiment of this second form is shown as a block circuit diagram in FIG. 2 which shows a multiple loop detector apparatus. The operation of the apparatus can be understood from the timing diagram of FIG. 3 to which reference will first be made to explain the principle.

Figure 3:
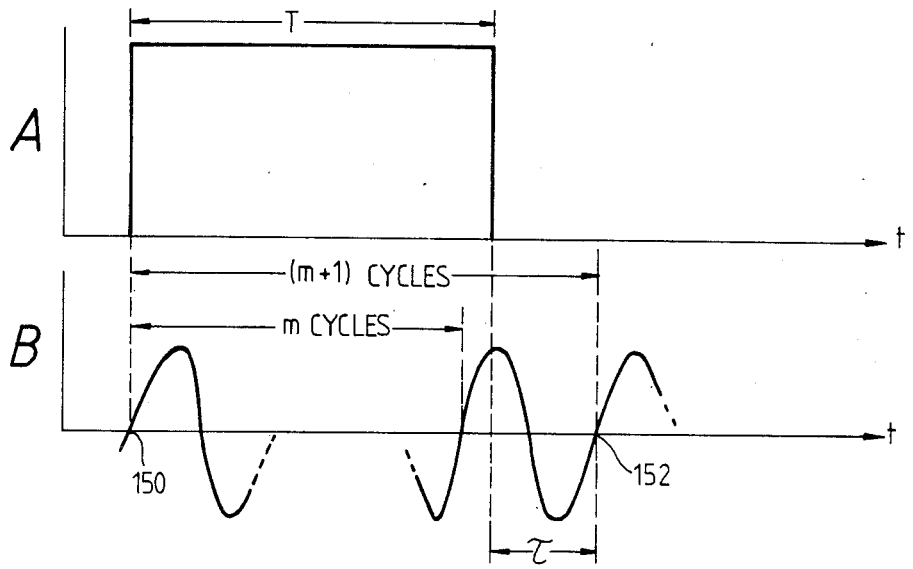
FIG. 3 is a timing diagram pertaining to the operation of the circuit of FIG. 2.

In FIG. 3 there is shown at A a timer pulse of predetermined duration T and at B the waveform of a loop oscillator. It is assumed that the leading edge of the pulse is synchronized with a first predetermined point 150 on the waveform as for example a positive-going, zero-crossing which is a well-defined point. This can be arranged by triggering the timer from the waveform.

A measure is made of the time difference $\tau$ between the trailing edge of the timer pulse and the nth following occurrence of a second predetermined point on the waveform. In practice $n=1$ is chosen, that is the next occurrence of that second predetermined point. The second predetermined point is also conveniently selected as a positive-going, zero-crossing and is indicated as 152 for the case of $n=1$. Clearly $\tau$ will vary as a function of the loop oscillator frequency and changes in $\tau$ can be analysed to determine vehicle presence. When $n=1$, the maximum value that $\tau$ can have is $1/f$ where f is the loop oscillator frequency. If $T>>1/f$ then $T>>\tau$. If detection were to be signalled on a given change $\Delta\tau$ between successive measurements, the time sensitivity is $\Delta\tau/T$ to a close approximation and like the embodiment of FIG. 1 is independent of loop oscillator frequency. Thus apparatus operating in the fashion can be set for a given time sensitivity without regard to the loop with which it is to be used.

Before describing suitable apparatus, FIG. 3 will be further considered as to a problem which arises in implementation.

By choosing the first and second waveform points 150, 152 to have a like characteristic, i.e. positive-going, zero-crossings, there are an exact number of cycles in period $T+\tau$ which number will be denoted as $(m+1)$ so that there are m cycles within the timer interval T. If a vehicle approaches the loop and the loop oscillator frequency rises, the $(m+1)$th cycle moves forward in time relative to the start of the timer interval and eventually "disappears" within the interval T. Detection then jumps to the $(m+2)$th cycle and $\tau$, which will have been measured as approaching zero, suddenly increases to a maximum value $1/f$. Thus in analysing successive values of $\tau$, and particularly where environmental tracking adjustments of the values used in the analysis are made in dependence on rates of change in $\tau$, it is necessary to take the jump into account in doing comparisons. This is possible by either noting when $\tau$ becomes zero (within some prescribed limit) during the detection of the $(m+1)$th cycle or by separately detecting the advance of the relevant zero-crossing past the trailing edge of the timer pulse T. In either case, the jump to the $(m+2)$th cycle will set a new value for $\tau$ of $T/(m+1)$. It will be realised that a similar situation occurs for a decreasing loop oscillator frequency. The number of cycles in the interval T decreases from m to $(m-1)$ as the mth cycle recedes in time beyond T. Detection then jumps from the $(m+1)$th cycle to the mth and $\tau$ changes from a maximum value $T/(m+1)$ to zero.

The foregoing clearly requires a knowledge of m. This can be done by initially counting the oscillator cycles occurring within the interval T to obtain m. This can be done by making the count on each measurement. An alternative is, that having established the initial m, one (1) is added to or subtracted from the current value of m each time a passing of the second predetermined point through the trailing edge of timer T is detected. This will apply to non-integral numbers of cycles as well as to the integral number case described.

A precise calculation of the loop oscillator period which avoids the need to detect the passage of the second predetermined point through the trailing edge of T, is to terminate the loop cycle counting at point 152. The number of cycles is exact at this point, i.e. $(m+1)$ in the illustrated case and the total time is also precise $(T+\tau)$. In practical terms this procedure can be implemented by counting the $(m+1)$ cycles at each measurement made.

Figure 2:
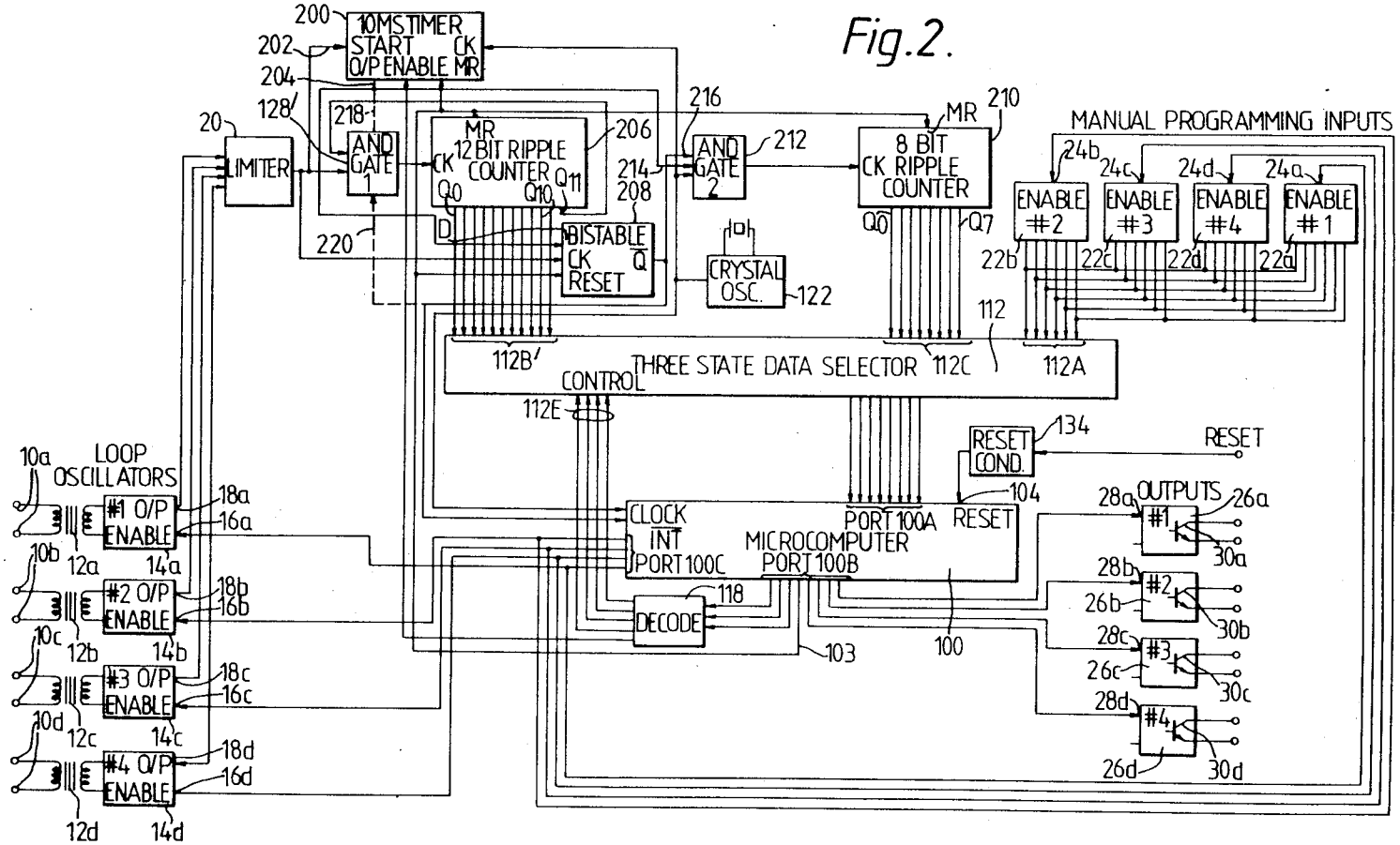
FIG. 2 is a block circuit diagram of a multiple-loop, vehicle detector apparatus in which a timer is used in each repeated measurement to set a time base against which oscillator changes are made.

Further consideration can now be given to FIG. 2 which is a block diagram of a multiple loop scanning circuit having much in common with that of FIG. 1 but employing the timing technique explained with reference to FIG. 3, and more specifically the modification last-mentioned. Digital timing is utilised. In FIG. 2, parts like to those of FIG. 1 are given like reference numerals. Where circuit operation is like that of the circuit of FIG. 1, a description of it will not be repeated except so far as necessary to understanding the timing arrangements of FIG. 2 upon which attention will be concentrated.

In FIG. 2 the time base period T of FIG. 3 is set by a digital timer 200, i.e. based on a digital counter. The enabling of the timer is under the control of the microcomputer 100 through decoder 118. The timer has a clock input (CK) clocked from clock oscillator 122. It also has a start input 202 whereby the timer is synchronized to a given polarity transition of the loop oscillator pulses from limiter 20. The counter unit within timer 200 may be a pre-settable down counter set by the enable signal to a count value equivalent to 10 mS at the clock oscillator rate. Upon counting down to zero (0) the timer generates an output signal on line 204 that marks the end of the 10 mS interval.

A 12-bit ripple counter 206 acts as a loop cycle counter and has its outputs $Q_0$ to $Q_{10}$ connected to a port 112B' of the data selector 112. Because there are 11 bits to be read rather than the 8 bits from counter 114 in FIG. 1, the data selector 112 and the control exercised by the microcomputer 100 are modified to read the 11 bits in 2 bytes to suit the 8-bit capability of port 100A. The counter 206 is clocked at its clock input (CK) by the loop oscillator pulses supplied through AND-gate 128' whose enabling in this case is dependent on the state of the $Q_{11}$ output of counter 206 acting to provide fault indication as before and on the state of a D-latch bistable 208. Further description of the control of the counting period of the counter 206 is given below.

The bistable 208 is used to detect the next transition of the loop oscillator pulses which corresponds to that that started the timer and which next follows the end of the timer period, i.e. the point 152 in FIG. 3. In this case there will be an integral number of cycles from the start of the timer period (corresponding to point 150 in FIG. 3). To this end the bistable has its clock input (CK) connected to the output of limiter 20 so as to respond to the required polarity transition. The D input of bistable 208 is connected to the output of timer 200 so that the $\overline{Q}$ output of the bistable goes low on the next appropriate transition of the loop oscillator pulses following activation of the timer output.

The period $\tau$ of FIG. 3 is measured by an 8-bit ripple counter 210 controlled by an AND-gate 212 to which the clock pulses are applied. The gate has two enabling inputs 214 and 216 connected to the timer output 204 and the $\overline{Q}$ output of bistable 208. These outputs control the gate to transmit clock pulses to the clock input (CK) of counter 210 for the interval $\tau$ defined as being the period between the activation of the timer output and the setting of the bistable. Consequently a count value representing $\tau$ is established in counter 210 for transfer into the microcomputer.

The clocking of the loop cycle counter 206 has been described but not the start and termination of the count. The start is controlled by the microcomputer issuing a master reset signal (MR) from port 100B to the timer 200 and counters 206 and 210 and then enabling the timer. Synchronization could be achieved by having the AND-gate 128' controlled by a signal from the timer consequent upon the receipt of an appropriate loop oscillator pulse transition at the start input.

In order to terminate the loop oscillator count, if the gate 128' were also made dependent upon the timer output 204 as shown by dashed line connection 218, such an arrangement would result in the count accumulated in the counter 206 representing the duration of the timer period T, i.e. the count value m as defined with reference to FIG. 3. However as is seen from FIG. 3 unless the mth cycle coincides with the end of period T the calculated loop oscillator period T/m will not be precise.

A better arrangement is to control the gate 128' in dependence upon the output of bistable 208 as indicated by dashed line connection 220. In this case the counter 206 will cease counting at a time corresponding to the point 152 in FIG. 3. This represents the duration of $(m+1)$ cycles as defined with reference to FIG. 3. The period $(T+\tau)$ is precisely that of these $(m+1)$ cycles and the loop oscillator period is accurately calculable from the known T together with the measured $\tau$ and $(m+1)$ from counters 210 and 206 respectively.

This latter modification avoids the need to detect transitions in time of the mth cycle past the end of period T. In operation of the circuit of FIG. 2, a loop cycle count is made for each oscillator sampled on each occasion it is sampled.

The general sequence of sampling is as described with reference to FIG. 1. A small delay is preferably provided to allow the enabled oscillator to settle. The values in counters 206 and 210 are transferred to the microcomputer for analysis during the sampling period of the next oscillator.

As in the apparatus of FIG. 1, there is no prior setting of the number of loop oscillator cycles. The apparatus simply operates with whatever number of loop cycles occur within the set period T. The FIG. 2 apparatus does not even establish an operational number for each loop. It merely monitors on each measurement the number of cycles corresponding to the timer period.

Again, as in the case of FIG. 1, the timing function of the external timer 200 can be performed instead by software.

Figure 4:
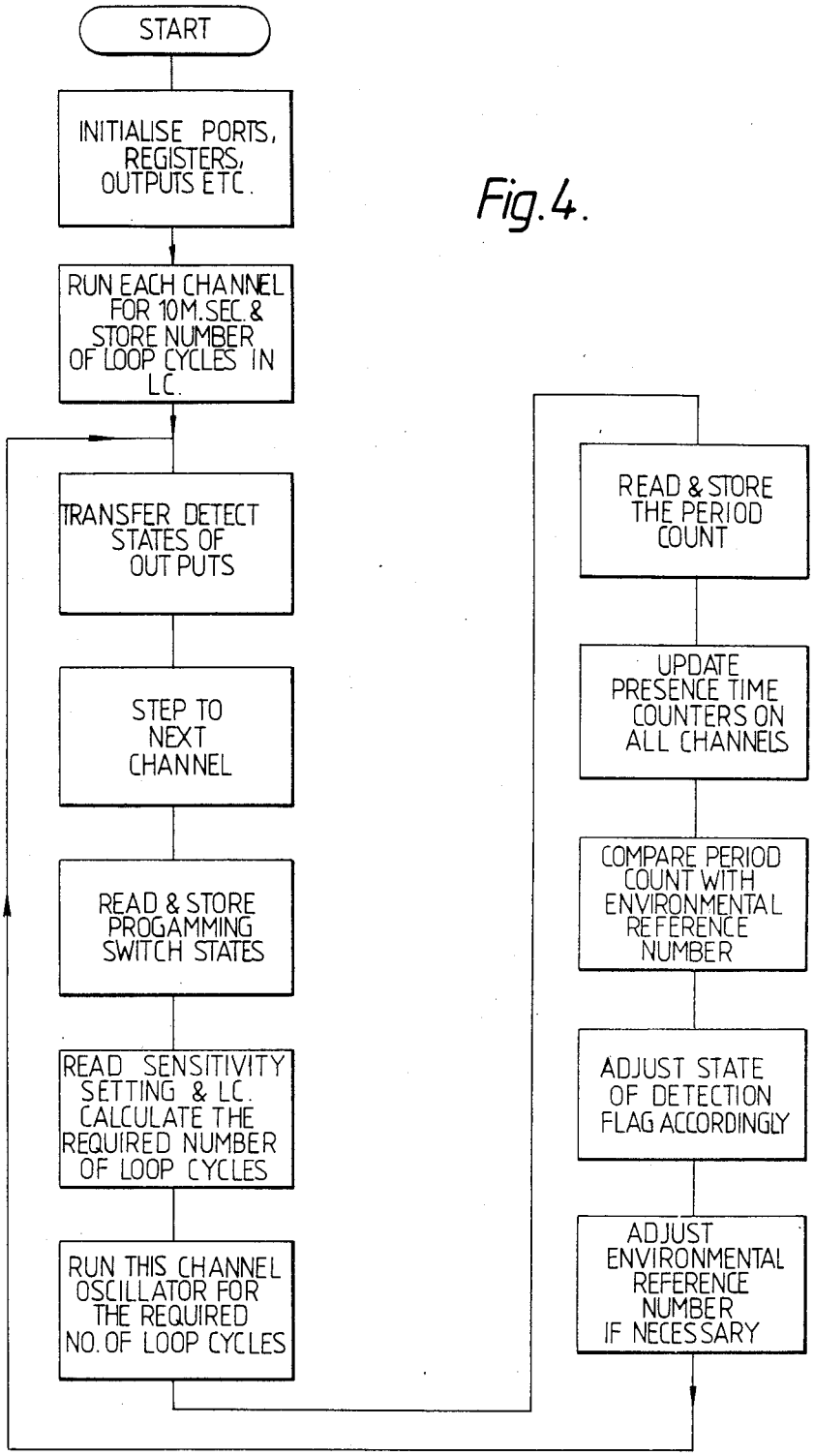
FIG. 4 is a flow diagram for the embodiment of FIG. 1.
Figure 5:
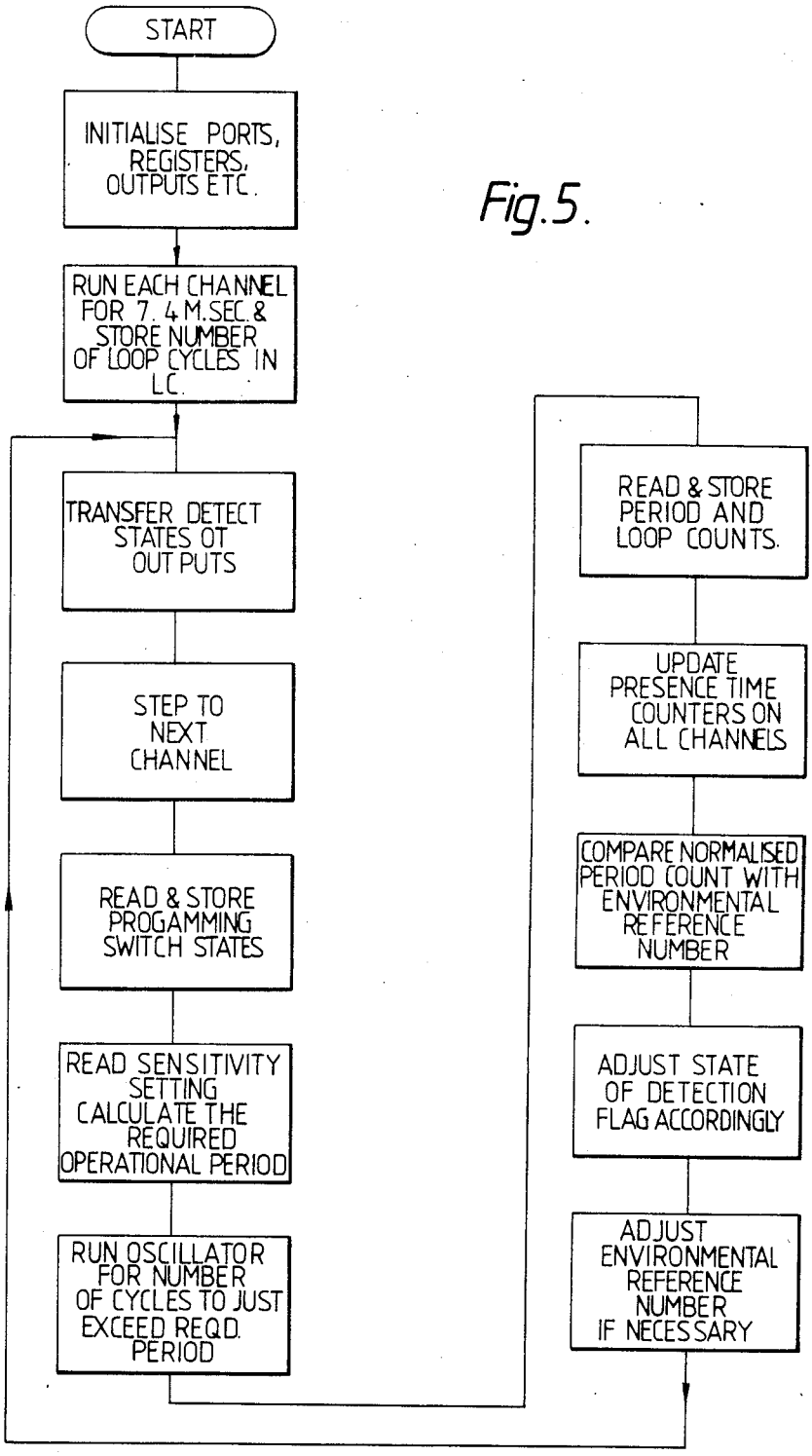
FIG. 5 is a flow diagram for the embodiment of FIGS. 2 and 3.

To further assist understanding of the implementation of the techniques according to the invention, FIG. 4 provides a flow diagram of the embodiment of FIG. 1, and FIG. 5 provides a flow diagram of the embodiment of FIGS. 2 and 3.

We claim:

1. A vehicle detection apparatus connectable to a vehicle sensing loop and including an oscillator for oscillating at a frequency dependent on the inductance of the loop, duration measuring means for repetitively measuring, when the apparatus is in a detection mode, the duration of a plurality of oscillator cycles, and means for analysing successive measured durations to determine the presence of a vehicle, and a circuit arrangement for establishing, during an initialising procedure, the number of oscillator cycles whose duration is to be measured during the detection mode, said circuit arrangement comprising:

a counter for counting oscillator cycles, a timer connected to control said counter to count oscillator cycles for a predetermined interval, and number storing means for storing the number of oscillator cycles counted in said interval as a value determining said number of oscillator cycles to be measured.

2. Vehicle detection apparatus as claimed in claim 1 in which said circuit arrangement includes means for actuating said timer in response to a predetermined condition arising.

3. Vehicle detection apparatus as claimed in claim 2 in which said predetermined condition is the power-up of the apparatus or a reset condition.

4. Vehicle detection apparatus as claimed in claim 1, or claim 2 or claim 3 in which said circuit arrangement includes a microcomputer for controlling actuation of said timer, said number storing means being data storage associated with the microcomputer, and said microcomputer also providing said means for analysing successive measured durations.

5. Vehicle detection means as claimed in claim 1 or claim 2 or claim 3 in which said duration measuring means includes a pre-settable down counter settable to a count value established by said stored number and operable to count down to a set point, and a clock pulse source and a further counter operable in synchronism with the down counter to count clock pulses up to the reaching of said set point so as to achieve a count value that is dependent on the duration of said number of oscillator cycles.

6. A vehicle detection apparatus as claimed in claim 1 or claim 2 or claim 3 connectable to a plurality of vehicle sensing inductive loops, including means for successively sampling the respective loop oscillator frequencies, and further comprising control means operable to control the initialising procedure in said apparatus to perform a series of samplings associated with different ones of said loops, to actuate said timer for each loop sampled in the initialising procedure whereby said counter achieves in the predetermined interval a count value dependent on the frequency of the sampled loop; and to cause the count values associated with the different loops to be stored in said storage means; and said control means being further operable to put the apparatus into a normal vehicle detection mode in which the respective stored count value associated with each loop determines the number of oscillator cycles whose duration is measured whenever the respective loop oscillator frequency is sampled.

7. A vehicle detection apparatus connectable to a vehicle sensing loop and including an oscillator for oscillating at a frequency dependent on the inductance of the loop, means for repetitively measuring, when the apparatus is in a detection mode, the duration of a plurality of oscillator cycles, means for analyzing successive measured durations to determine the presence of a vehicle, and a circuit arrangement for establishing the number of oscillator cycles whose duration is to be measured, said circuit arrangement comprising:

a timer actuable in a predetermined relationship to the oscillator waveform and generating a signal at a predetermined time following actuation of the timer; and interval-measuring means responsive to said signal and to the oscillator waveform to measure the interval between said timer signal and a predetermined point on the waveform following said timer signal.

8. A vehicle detection apparatus as claimed in claim 7, in which said timer is triggerable at a predetermined point on the oscillator waveform, to produce a pulse of predetermined duration, and said analyser interval measuring means includes means responsive to the trailing edge of said timer pulse and to a predetermined point on the oscillator waveform to measure the interval therebetween.

9. A vehicle detection apparatus as claimed in claim 8, in which said timer is triggerable by a zero crossing or edge of given slope of the oscillator waveform.

10. A vehicle detection apparatus as claimed in claim 8 or claim 9 in which said interval measuring means is responsive to the nth zero-crossing or edge of given slope of the oscillator waveform following the trailing edge of said timer pulse, where n is prescribed.

11. A vehicle detection apparatus as claimed in claim 10 in which $n=1$.

12. A vehicle detection apparatus as claimed in claim 7 or claim 8 or claim 9 comprising a counter controlled by the timer to count the number of oscillator cycles within the predetermined time defined by the timer, means for storing that count value, means for detecting the advance or retreat of each point, corresponding to the predetermined point, on the oscillator waveform, to adjust said stored count value, and means operable to calculate the period of the oscillator waveform at each such detection in response to said predetermined time and the adjusted count value.

13. A vehicle detection apparatus as claimed in claim 7, and comprising means for generating a second signal upon detection of a predetermined point on the oscillator waveform following said timer signal;

and a counter for establishing the number of oscillator cycles occurring between the actuation of the timer and the detection of said predetermined point; and wherein said duration measuring means is operable to measure the interval between said timer signal and said second signal, and said analyzer means is operable to analyze variations in said interval over successive measurements having regard to any variation of said established number of cycles.

14. Apparatus as claimed in claim 13 further comprising a clock for generating clock pulses and in which said timer comprises a counter for counting a predetermined number of clock pulses to determine said predetermined time.

15. Apparatus as claimed in claim 13 or claim 14 wherein said duration measuring means comprises a counter for counting clock pulses as a measure of said time interval.

16. Apparatus as claimed in claim 13 or claim 14 in which the actuation of said timer is at a point on the oscillator waveform corresponding to said predetermined point whereby the established number of oscillator cycles is a whole number.

17. Apparatus as claimed in claim 13 or claim 15 in which said predetermined point is the next such point on the oscillator waveform following said first signal.

18. Apparatus as claimed in claim 13 or claim 15 in which said analyzer means comprises a microcomputer operable to calculate the loop oscillator period from the predetermined time, the measured time interval between the timer and second signals and said established number of cycles and to adjust the analyzed time intervals in dependence upon the calculated period when the established number of cycles changes.

* * * * *